US006416680B1

(12) United States Patent
Mitsuzawa et al.

(10) Patent No.: US 6,416,680 B1
(45) Date of Patent: Jul. 9, 2002

(54) INK-JET RECORDING HEAD, ITS MANUFACTURING METHOD AND INK-JET RECORDING DEVICE

(75) Inventors: Toyohiko Mitsuzawa; Fujio Akahane; Shinri Sakai; Akira Matsuzawa, all of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/433,025

(22) Filed: Nov. 3, 1999

Related U.S. Application Data

(62) Division of application No. 09/254,481, filed on Apr. 8, 1999.

(30) Foreign Application Priority Data

Jul. 18, 1997 (JP) ..... 9-194499
Apr. 24, 1998 (JP) ..... 10-115098

(51) Int. Cl.[7] ..... B41J 2/04
(52) U.S. Cl. ..... 216/27; 438/21; 437/68
(58) Field of Search ..... 216/27; 347/68; 438/21

(56) References Cited

U.S. PATENT DOCUMENTS 6,070,972 A * 6/2000 Thiel ..... 347/71

FOREIGN PATENT DOCUMENTS

| | | | | |
|---|---|---|---|---|
| EP | 0237 282 | * | 9/1987 | ..... B41J/3/04 |
| JP | 4-216060 | | 8/1992 | ..... B41J/2/16 |
| JP | 4-345854 | | 12/1992 | ..... B41J/2/045 |
| JP | 5-286131 | | 11/1993 | ..... B41J/2/045 |
| JP | 6-297701 | | 10/1994 | ..... B41J/2/045 |
| JP | 6-320723 | | 11/1994 | ..... B41J/2/045 |

* cited by examiner

*Primary Examiner*—Randy Gulakowski
*Assistant Examiner*—Shamim Ahmed
(74) *Attorney, Agent, or Firm*—Sughrue Mion, PLLC

(57) ABSTRACT

The present invention relates to an ink-jet recording head, its manufacturing method and an ink-jet recording device wherein a part of a pressure generating chamber communicating with a nozzle aperture for jetting an ink droplet is composed of a diaphragm and an ink droplet is jetted by the displacement of a piezoelectric layer formed on the surface of the diaphragm.

A connection between a lead electrode for applying voltage to a piezoelectric element including a lower electrode, the piezoelectric layer and an upper electrode respectively formed in an area corresponding to the pressure generating chamber and the piezoelectric element is provided in an area opposite to a passage communicating with the pressure generating chamber other than an area opposite to the pressure generating chamber.

For its manufacturing method, a narrow part which communicates with one end of the pressure generating chamber and is narrower than the width of the pressure generating chamber is formed by piercing a passage forming substrate by etching.

The ink-jet recording head according to the present invention is mounted in an ink-jet recording device and used for recording a character and image information on a recording medium such as paper using ink.

4 Claims, 15 Drawing Sheets

INK-JET RECORDING HEAD, ITS MANUFACTURING METHOD AND INK-JET RECORDING DEVICE

This is a divisional of application Ser. No. 09/254,481 filed Apr. 8, 1999, the disclosure of which is incorporated herein by reference.

TECHNICAL FIELD

The present invention relates to an ink-jet recording head, its manufacturing method and an ink-jet recording device wherein a piezoelectric element is formed in a part of a pressure generating chamber communicating with a nozzle aperture for jetting an ink droplet via a diaphragm so that an ink droplet is jetted by the displacement of the piezoelectric element.

BACKGROUND ART

For an ink-jet recording head wherein a part of a pressure generating chamber communicating with a nozzle aperture for jetting an ink droplet is constituted by a diaphragm and an ink droplet is jetted from the nozzle aperture by deforming the diaphragm by a piezoelectric element and pressurizing ink in the pressure generating chamber, two types of a type that a piezoelectric actuator in a longitudinal vibration mode for extending or contracting a piezoelectric element axially is used and a type that a piezoelectric actuator in a flexural vibration mode for bending a piezoelectric element is used are realized.

For the former, the volume of a pressure generating chamber can be varied by touching the end face of a piezoelectric element to a diaphragm and a head suitable for high density printing can be manufactured, however, on the other hand, there is a problem that a difficult process for cutting a piezoelectric element in the form of the tooth of a comb in accordance with the arrangement pitch of nozzle apertures and work for positioning and fixing the cut piezoelectric element over a pressure generating chamber are required and its manufacturing process is complicated.

In the meantime, for the latter, a piezoelectric element can be fixed on a diaphragm in a relatively simple process for sticking a green sheet which is piezoelectric material in accordance with the shape of a pressure generating chamber and burning it, however, on the other hand, there is a problem that area to some extent is required because flexural vibration is utilized and high density arrangement is difficult.

In the meantime, to solve the problem of the recording head equivalent to the latter, as disclosed in Japanese published unexamined patent application No. Hei5-286131, a recording head wherein a piezoelectric element is independently formed every pressure generating chamber by forming a uniform piezoelectric material layer on the whole surface of a diaphragm by thin film technique and cutting the piezoelectric material layer in a shape corresponding to each pressure generating chamber by lithography is proposed.

Hereby, there is an advantage that work for sticking a piezoelectric element on a diaphragm is not required, not only a piezoelectric element can be fixed by a precise and convenient method such as lithography but the piezoelectric element can be thinned and high speed driving is enabled. In this case, a piezoelectric element corresponding to each pressure generating chamber can be driven by providing at least only an upper electrode every pressure generating chamber with a piezoelectric material layer provided on the whole surface of a diaphragm.

In the recording head using such a piezoelectric actuator in a flexural mode, a lead electrode for supplying voltage for driving a piezoelectric element corresponding to each pressure generating chamber is provided corresponding to each pressure generating chamber.

However, as described above, there is a problem that large stress is readily caused by the driving of a piezoelectric element in a connection (hereinafter called a contact) between a piezoelectric element corresponding to each pressure generating chamber and a lead electrode, and a crack and breaking may be caused.

There is also a problem that as a lead electrode is connected to a contact, displacement by applying voltage is small, compared with that in another part, however, nevertheless, as compliance is not small, compared with that in another part, jetting speed is deteriorated and driving voltage is increased.

Further, there is a problem that a crack is readily made in a piezoelectric layer in the vicinity of such a contact hole.

There is also a case that a piezoelectric element is sequentially pulled out over the peripheral wall of a pressure generating chamber to supply voltage for driving each piezoelectric actuator, however, in this case, there is a problem that a crack is readily made in a part in which a piezoelectric element crosses a boundary between a pressure generating chamber and the peripheral wall of a piezoelectric layer.

In the meantime, in the above ink-jet recording head, structure in which a diaphragm in a part corresponding to both sides in the direction of the width of a piezoelectric element is thinned is proposed to enhance the efficiency of the displacement of a diaphragm by the driving of the piezoelectric element. However, if displacement is increased as described above, a tendency that breaking such as a crack is readily caused particularly in the vicinity of the above peripheral wall of a pressure generating chamber or in the vicinity of a contact hole is promoted.

The problem that jetting speed is deteriorated and driving voltage is increased and the problem that breaking such as a crack is readily caused in the vicinity of the peripheral wall of a pressure generating chamber or in the vicinity of a contact hole come into question particularly in case a piezoelectric material layer is formed by film forming technique. That is, it is because a piezoelectric material layer formed by film forming technique is very thin and the rigidity is low, compared with that of a piezoelectric material layer in which a piezoelectric element is stuck.

The present invention is made in view of such a situation and the object is to provide an ink-jet recording head, its manufacturing method and an ink-jet recording device wherein a crack, breaking and others due to stress concentration in a contact are prevented and the efficiency of displacement in the contact can be prevented from being deteriorated.

The present invention is made in view of such a situation and the object is to provide an ink-jet recording head, its manufacturing method and an ink-jet recording device wherein a crack and others in a piezoelectric element, in the vicinity of the peripheral wall of a pressure generating chamber of a piezoelectric layer and in the vicinity a contact hole are prevented and durability can be secured.

DISCLOSURE OF THE INVENTION

A first embodiment of the present invention to solve the above problems relates to an ink-jet recording head based upon an ink-jet recording head wherein plural pressure generating chambers each of which communicates with a nozzle aperture are formed and a piezoelectric element at least including a lower electrode, a piezoelectric layer and an upper electrode is formed in an area corresponding to one of the plural pressure generating chambers and characterized in that a connection between a lead electrode for applying voltage to the piezoelectric element and the piezoelectric element is provided in an area opposite to a passage communicating with the pressure generating chamber other than the area opposite to the above pressure generating chamber.

According to such a first embodiment, as the connection between the lead electrode and the piezoelectric element is formed in an area other than the area opposite to the pressure generating chamber, the quantity of displacement of the pressure generating chamber by the piezoelectric element can be increased.

A second embodiment of the present invention relates to an ink-jet recording head based upon the first embodiment and characterized in that a narrow part which communicates with the end far from the above nozzle aperture of the above pressure generating chamber and at least one of the width and the depth of which is smaller than that of the pressure generating chamber and a communicating part which communicates with the pressure generating chamber via the narrow part are provided and a connection between the above piezoelectric element and the above lead electrode is provided in an area opposite to the above communicating part.

According to such a second embodiment, as the connection to the lead electrode is formed in a position opposite to the communicating part which communicates with the pressure generating chamber via the narrow part, deformation is hardly made in the connection, the breaking of the piezoelectric layer and others in the vicinity of the connection is avoided and displacement is not deteriorated by the connection.

A third embodiment of the present invention relates to an ink-jet recording head based upon the second embodiment and characterized in that the width of the above narrow part is formed so that it is narrower than the width of the above pressure generating chamber, the above upper electrode is independently formed every area opposite to the pressure generating chamber so that it is narrower than the width of the pressure generating chamber and formed so that the upper electrode continues to a part provided in an area opposite to the above communicating part via a narrow lead provided in a part opposite to the narrow part.

According to such a third embodiment, even if voltage is applied via the lead electrode, the breaking of the piezoelectric layer and others is avoided without concentrating stress on the piezoelectric layer in the narrow part and the communicating part and the pressure generating chamber can be effectively displaced.

A fourth embodiment of the present invention relates to an ink-jet recording head based upon the second embodiment and characterized in that the width of the above narrow part is formed so that it is narrower than the width of the above pressure generating chamber, the above upper electrode is independently formed every an area opposite to the pressure generating chamber so that it is narrower than the width of the pressure generating chamber and formed so that the upper electrode continues to a part provided in an area opposite to the above communicating part via the narrow lead provided in a part opposite to the narrow part, the above piezoelectric layer is formed corresponding to the upper electrode over the pressure generating chamber and extended to an area corresponding to the narrow part and the communicating part in approximately the same width.

According to such a fourth embodiment, as the piezoelectric layer is provided up to a position opposite to the outside of a passage in an area opposite to the narrow part, the displacement of the piezoelectric layer particularly in the narrow part and a boundary between the pressure generating chamber and the communicating part can be further reduced and the breaking of the piezoelectric layer is further prevented.

A fifth embodiment of the present invention relates to an ink-jet recording head based upon the second embodiment and characterized in that the width of the above narrow part is formed so that it is narrower than that of the above pressure generating chamber, the above piezoelectric layer and the above upper electrode are independently formed every area opposite to the pressure generating chamber so that the width of them is narrower than that of the pressure generating chamber and formed so that the piezoelectric layer and the upper electrode continue to a part provided in the opposite area of the communicating part via a narrow lead provided in a part opposite to the narrow part.

According to such a fifth embodiment, the piezoelectric layer is provided opposite to the pressure generating chamber, the narrow part and the communicating part, however, even if voltage is applied via the lead electrode, displacement is hardly caused in the narrow part and the communicating part and the pressure generating chamber can be effectively displaced.

A sixth embodiment of the present invention relates to an ink-jet recording head based upon any of the third to fifth embodiments and characterized in that each boundary between the above lead formed narrowly and a part in an area opposite to the above pressure generating chamber and between the lead and a part in an area opposite to the above communicating part is formed in a radial form.

According to such a sixth embodiment, as the boundaries at both ends of the lead are respectively formed in a radial form, a crack and others are further difficult to cause.

A seventh embodiment of the present invention relates to an ink-jet recording head based upon any of the second to sixth embodiments and characterized in that said communicating part is composed of a common passage communicating with each pressure generating chamber via each narrow part.

According to such a seventh embodiment, vibration in the vicinity of the connection due to voltage applied from the lead electrode can be prevented and the generation of a crack and others of the piezoelectric element is further inhibited.

An eight embodiment of the present invention relates to an ink-jet recording head based upon any of the first to seventh embodiments and characterized in that an insulating layer provided with a window in a part corresponding to said connection to at least said lead electrode is formed on the upper surface of said upper electrode.

According to such an eighth embodiment, insulation between the upper electrode and the lower electrode and cutoff from the air can be secured by providing the insulating layer.

A ninth embodiment of the present invention relates to an ink-jet recording head based upon the eighth embodiment and characterized in that the above insulating layer is formed by silicon oxide, silicon nitride and organic material such as polyimide.

According to such a ninth embodiment, an insulating layer can be readily formed by a film forming process and a lithographic process for example.

A tenth embodiment of the present invention relates to an ink-jet recording head based upon an ink-jet recording head wherein plural pressure generating chambers respectively communicating with a nozzle aperture and a piezoelectric element including at least a lower electrode, a piezoelectric lay and an upper electrode in an area corresponding to the pressure generating chamber are formed and characterized in that a communicating part communicating with an ink supply port to which ink is supplied from the outside and the above pressure generating chamber communicate via a narrow part narrower than the width of the corresponding pressure generating chamber and the vicinity of the end on the side of the narrow part of the pressure generating chamber is provided with a narrow part the width of which is gradually narrowed.

According to such a tenth embodiment, the quantity of displacement of the piezoelectric element in a part corresponding to the narrow part is inhibited and the breaking and others of the piezoelectric layer are prevented. An eleventh embodiment of the present invention relates to an ink-jet recording head based upon the tenth embodiment and characterized in that the width of the above narrow part is in the range of 1 to 99% of the width of the above pressure generating chamber.

According to such an eleventh embodiment, the inflow of ink into the pressure generating chamber can be adjusted depending upon the width of the narrow part.

A twelfth embodiment of the present invention relates to an ink-jet recording head based upon the tenth or eleventh embodiment and characterized in that at least the above piezoelectric layer of the above piezoelectric element formed in an area opposite to the above pressure generating chamber is continuously extended from the area opposite to the pressure generating chamber to an area opposite to the above narrow part and the above communicating part.

According to such a twelfth embodiment, as the piezoelectric layer is extended to the area opposite to the narrow part and the communicating part, the breaking and others of the piezoelectric layer are prevented.

A thirteenth embodiment of the present invention relates to an ink-jet recording head based upon any of the tenth to twelfth embodiments and characterized in that a connection between a lead electrode for applying voltage to the above piezoelectric element and the corresponding piezoelectric element is provided in an area opposite to the above communicating part.

According to such a thirteenth embodiment, as the connection between the lead electrode and the piezoelectric element is formed in a position opposite to the communicating part, deformation is hardly caused in the connection and the breaking of the piezoelectric layer and others in the vicinity of the connection is avoided.

A fourteenth embodiment of the present invention relates to an ink-jet recording head based upon the twelfth or thirteenth embodiment and characterized in that the width of the above piezoelectric layer is narrower than that of the above narrow parts.

According to such a fourteenth embodiment, the displacement of the piezoelectric layer is not regulated in the direction of the width and no strong stress acts upon the piezoelectric layer.

A fifteenth embodiment of the present invention relates to an ink-jet recording head based upon any of the tenth to fourteenth embodiments and characterized in that a common ink chamber to which ink is supplied from the above ink supply port communicates with each communicating part.

According to such a fifteenth embodiment, ink supplied from the ink supply port is supplied to the pressure generating chamber via the common ink chamber and each communicating part.

A sixteenth embodiment of the present invention relates to an ink-jet recording head based upon any of the tenth to fourteenth embodiments and characterized in that the communicating part communicating with each pressure generating chamber is mutually connected to form a reservoir.

According to such a sixteenth embodiment, ink supplied from the ink supply port is supplied to the pressure generating chamber via the reservoir.

A seventeenth embodiment of the present invention relates to an ink-jet recording head based upon any of the first to sixteenth embodiments and characterized in that the above narrow part is formed through the passage forming substrate in which the above pressure generating chamber is formed.

According to such a seventeenth embodiment, as adjustment in the direction of the thickness is not required, the narrow part can be readily formed.

An eighteenth embodiment of the present invention relates to an ink-jet recording head based upon any of the first to seventeenth embodiments and characterized in that the above piezoelectric element is formed on an elastic film formed on the passage forming substrate in which the above pressure generating chamber is formed.

According to such an eighteenth embodiment, the elastic film is deformed by the piezoelectric element and pressure in the pressure generating chamber changes.

A nineteenth embodiment of the present invention relates to an ink-jet recording head based upon any of the first to eighteenth embodiments and characterized in that the above pressure generating chamber is formed by a silicon monocrystalline substrate by anisotropic etching and each layer of the above piezoelectric element is formed by a film forming method and a lithographic method.

According to such a nineteenth embodiment, an ink-jet recording head provided with high density nozzle apertures can be relatively readily manufactured in a large quantity.

A twentieth embodiment of the present invention relates to an ink-jet recording device characterized in that an ink-jet recording head according to any of the first to nineteenth embodiments is provided.

According to such a twentieth embodiment, an ink-jet recording device wherein the efficiency of the driving of the head is enhanced and ink can be satisfactorily jetted can be realized.

A twenty-first embodiment of the present invention relates to a method of manufacturing an ink-jet recording head based upon a method of manufacturing an ink-jet recording head wherein a piezoelectric element is formed in an area corresponding to the above pressure generating chamber by sequentially laminating a lower electrode layer, a piezoelectric layer and an upper electrode layer on an elastic film provided on one side of a passage forming substrate and patterning each layer and the above passage forming substrate is etched from the other side so as to form a pressure generating chamber communicating with a nozzle aperture and characterized in that a step for forming a narrow part which communicates with one end of the above pressure generating chamber and which is narrower than the width of the corresponding pressure generating chamber by piercing the above narrow part by etching the above passage forming substrate is provided.

According to such a twenty-first embodiment, as adjustment in the direction of the thickness of the narrow part is not required, the narrow part is readily formed.

A twenty-second embodiment of the present invention relates to a method of manufacturing an ink-jet recording head based upon the twenty-first embodiment and characterized in that a step for forming the above narrow part is simultaneously executed with a step for forming the above pressure generating chamber by etching.

According to such a twenty-second embodiment, the narrow part can be readily formed without increasing the number of manufacturing processes.

A twenty-third embodiment of the present invention relates to a method of manufacturing an ink-jet recording head based upon the twenty-first or twenty-second embodiment and characterized in that the above pressure generating chamber is formed by a silicon monocrystalline substrate by anisotropic etching and each layer of the above piezoelectric element is formed by a film forming method and a lithographic method.

According to such a twenty-third embodiment, an ink-jet recording head provided with high density nozzle apertures can be relatively readily manufactured in a large quantity.

THE BEST EMBODIMENTS OF THE INVENTION

The present invention will be described in detail based upon embodiments below.

First Embodiment

Figure 1:
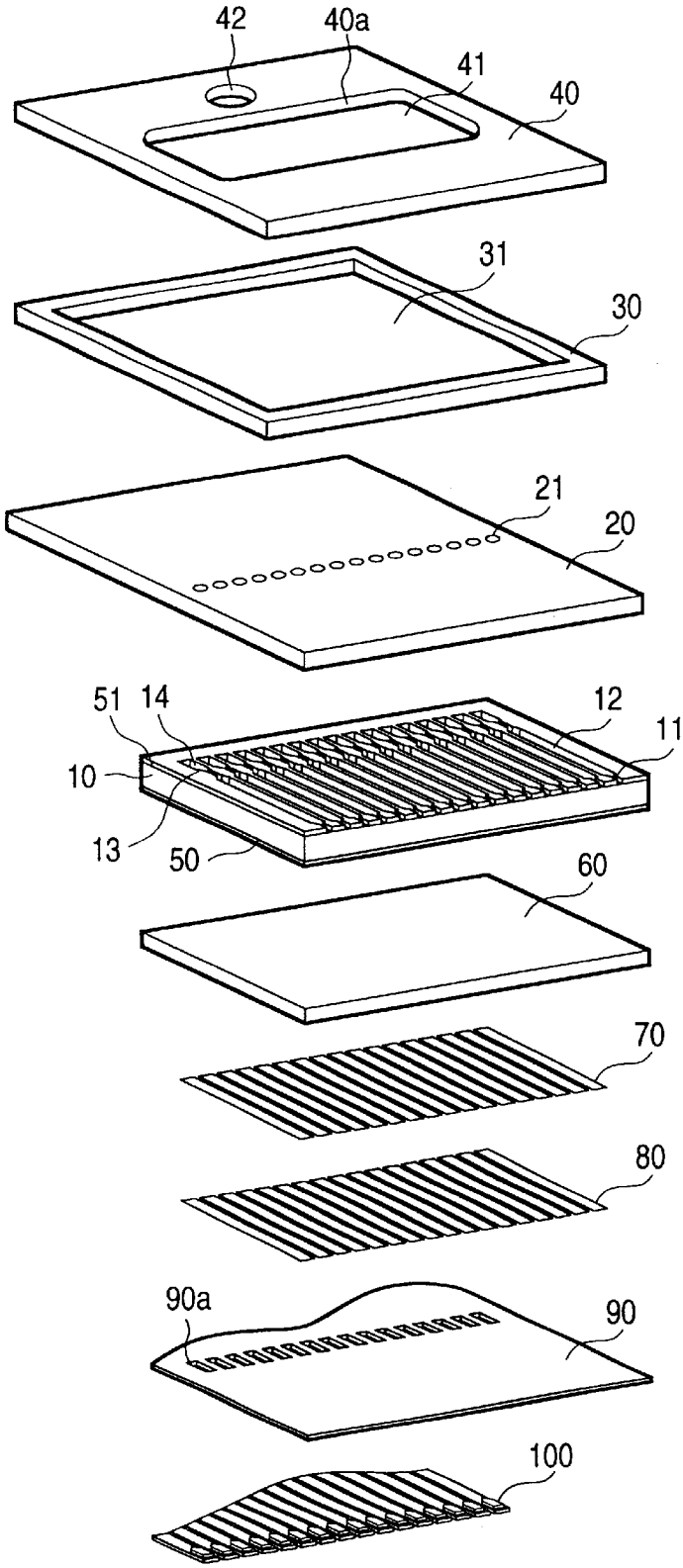
FIG. 1 is an exploded perspective view showing an ink-jet recording head equivalent to a first embodiment of the present invention.
Figure 2:
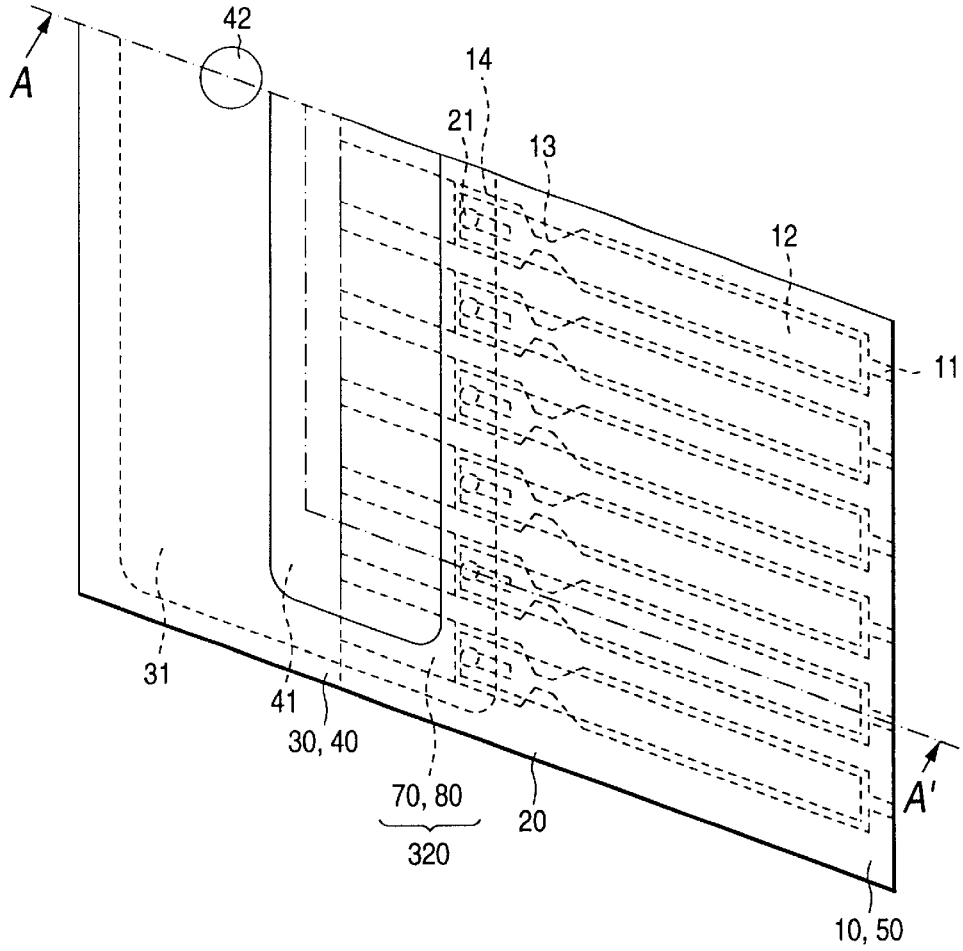
FIGS. 2(*a*)–(*b*) show the ink-jet recording head equivalent to the first embodiment of the present invention and are a plan of FIG. 1 and a sectional view.
Figure 2:
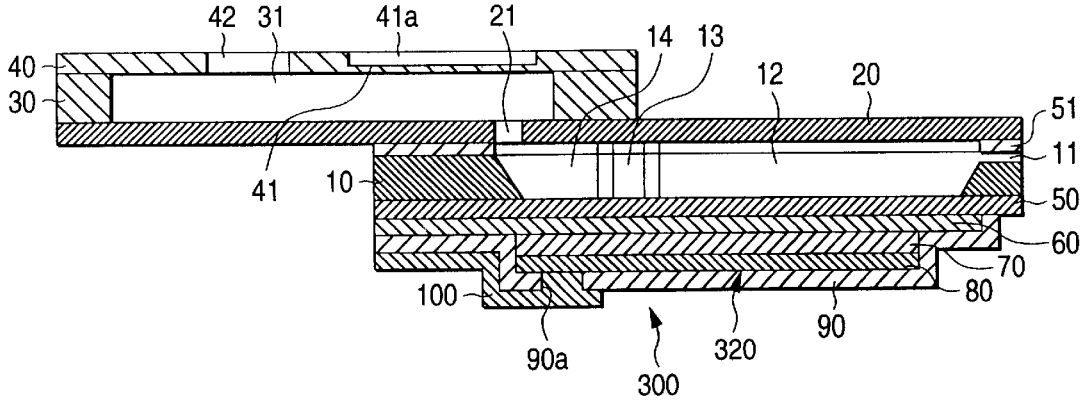

FIG. 1 is an exploded perspective view showing an ink-jet recording head equivalent to a first embodiment of the present invention and FIG. 2 show a plan of FIG. 1 and sectional structure in the longitudinal direction of one pressure generating chamber.

As shown in these drawings, a passage forming substrate 10 is composed of a silicon monocrystalline substrate with the face orientation of (110) in this embodiment. For the passage forming substrate 10, normally, a substrate with the thickness of approximately 150 to 300 $\mu$m is used, and desirably, a substrate with the thickness of approximately 180 to 280 $\mu$m and preferably, a substrate with the thickness of approximately 220 $\mu$m are suitable. This is because arrangement density can be enhanced, keeping the rigidity of a partition between adjacent pressure generating chambers.

Elastic films 50 and 51 with the thickness of 0.1 to 2 $\mu$m composed of silicon dioxide and formed by thermal oxidation beforehand are formed on both surfaces of the passage forming substrate 10. A nozzle aperture 11, a pressure generating chamber 12, a narrow part 13 and a communicating part 14 are formed on one surface of the passage forming substrate 10 by anisotropically etching the silicon monocrystalline substrate after the elastic film 51 is patterned.

Anisotropic etching is executed utilizing a character that when a silicon monocrystalline substrate is dipped in alkaline solution such as KOH, it is gradually eroded, a first face (111) perpendicular to a face (110) and a second face (111) at an angle of approximately 70° with the first face (111) and at an angle of approximately 35° with the face (110) emerge and the etching rate of the face (111) is approximately 1/180, compared with the etching rate of the face (110). By such anisotropic etching, precise processing can be executed based upon the processing in the depth of a parallelogram formed by the two first faces (111) and the two diagonal second faces (111) and the pressure generating chambers 12 can be arranged in high density.

In this embodiment, the longer side of each pressure generating chamber 12 is formed by the first face (111) and the shorter side is formed by the second face (111). Each narrow part 13 located on the reverse side to the nozzle aperture 11 of each pressure generating chamber 12 is narrower than the pressure generating chamber 12 and further, the communicating part 14 respectively communicating with the narrow part 13 has approximately the same width as the pressure generating chamber 12. These pressure generating chamber 12, narrow part 13 and communicating part 14 are formed by etching the passage forming substrate 10 up to the elastic film 50 approximately through the passage forming substrate in the same process. The elastic films 50 and 51 are not etched by alkaline solution for etching the silicon monocrystalline substrate.

In the meantime, each nozzle aperture 11 communicating with one end of each pressure generating chamber 12 is formed so that it is narrower and shallower than the pressure generating chamber 12. That is, the nozzle aperture 11 is formed by etching halfway in the direction of the thickness of the silicon monocrystalline substrate (half-etching). Half-etching is executed by adjusting etching time.

The size of the pressure generating chamber 12 for applying ink jetting pressure to ink, the size of the nozzle aperture 11 for jetting an ink droplet and the size of the narrow part 13 for controlling the flow of ink in the pressure generating chamber 12 are optimized according to the quantity of an ink droplet to be jetted, jetting speed and a jetting frequency. For example, if 360 ink droplets are recorded per inch, the nozzle aperture 11 and the narrow part 13 are required to be formed precisely so that they are a few tens $\mu$m wide.

The communicating part 14 is a junction chamber for connecting a common ink chamber 31 described later and the pressure generating chamber 12 via the narrow part 13, an ink supply communicating port 21 of a sealing plate 20 described later corresponds to it, ink is supplied from the common ink chamber 31 via the ink supply communicating port 21 and distributed to each pressure generating chamber 12. In this embodiment, the communicating part 14 is provided every pressure generating chamber 12, however, a common passage communicating with any pressure generating chamber 12 via the narrow part 13 may be also provided and in this case, the communicating part may also function as the common ink chamber described later.

Figure 3:
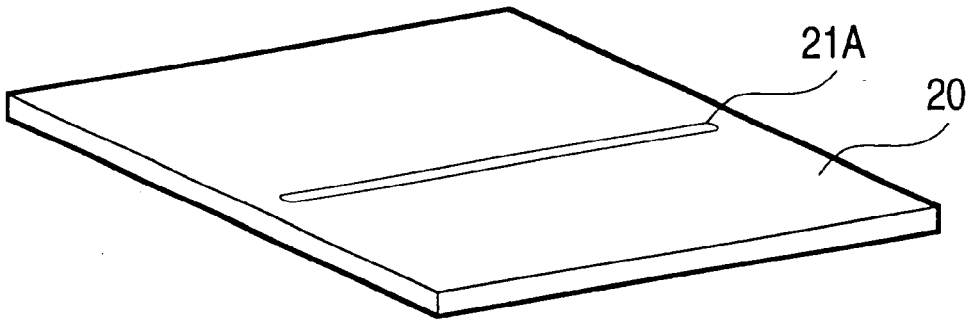
FIGS. 3(*a*)–(*b*) show an example in which a sealing plate shown in FIG. 1 is transformed.
Figure 3:
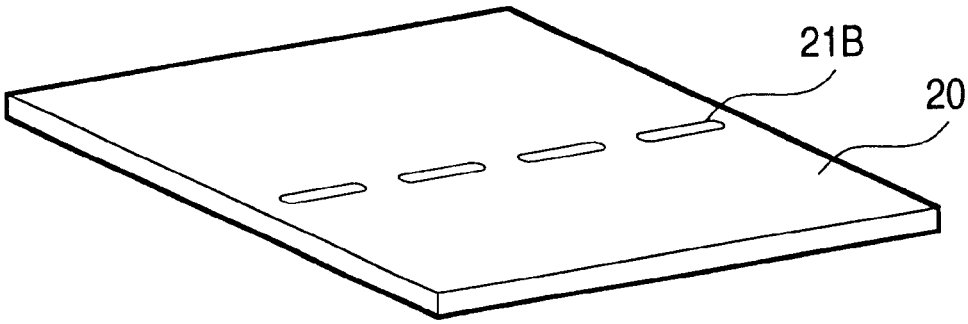

The sealing plate 20 is composed of glass ceramics through which the above ink supply communicating port 21 is made, the thickness of which is 0.1 to 1 mm for example and the coefficient of linear expansion of which is 2.5 to 4.5 [$\times 10^{-6}$/° C.] at 300° C. or less for example. The ink supply communicating port 21 may be also one slit 21A or plural slits 21B which respectively cross each communicating port 14 as shown in FIGS. 3(*a*) and 3(*b*). As one surface of the sealing plate 20 covers one surface of the passage forming substrate 10 overall, the sealing plate also functions as a reinforcing plate for protecting the silicon monocrystalline substrate from shock and external force. The other surface of the sealing plate 20 constitutes one wall of the common ink chamber 31.

A common ink chamber forming substrate 30 forms the peripheral walls of the common ink chamber 31 and is produced by punching a stainless steel plate with suitable thickness according to the number of nozzle apertures and an ink droplet jetting frequency. In this embodiment, the thickness of the common ink chamber forming substrate 30 is set to 0.2 mm.

An ink chamber side plate 40 is composed of a stainless steel substrate and one surface constitutes one wall of the common ink chamber 31. In the ink chamber side plate 40, a thin wall 41 is formed by forming a concave portion 40*a* by applying half-etching to a part of the other surface and further, an ink inlet 42 through which ink is supplied from the outside is formed by punching. The thin wall 41 is formed to absorb pressure to the reverse side to the nozzle aperture 11 which is generated when an ink droplet is jetted and prevents unnecessary positive or negative pressure from being applied to another pressure generating chamber 12 via the common ink chamber 31. In this embodiment, in view of rigidity required when the ink inlet 42 and external ink supply means are connected and others, the thickness of the ink chamber side plate 40 is set to 0.2 mm and the thin wall 41 0.02 mm thick is formed in a part, however, the thickness of the ink chamber side plate 40 may be also set to 0.02 mm from the beginning to omit the formation of the thin wall 41 by half-etching.

In the meantime, a lower electrode film 60 with the thickness of approximately 0.5 $\mu$m for example, a piezoelectric film 70 with the thickness of approximately 1 $\mu$m for example and an upper electrode film 80 with the thickness of approximately 0.1 $\mu$m for example are laminated on the elastic film 50 on the reverse side to the open face of the passage forming substrate 10 in a process described later and constitute a piezoelectric element 300. The piezoelectric element 300 includes the lower electrode film 60, the piezoelectric film 70 and the upper electrode film 80. Generally, either electrode of the piezoelectric element 300 is used as a common electrode, and the other electrode and the piezoelectric film 70 are constituted by patterning them every pressure generating chamber 12. A part which is composed of either electrode and the piezoelectric film 70 respectively patterned and in which piezoelectric distortion is caused by applying voltage to both electrodes is called a piezoelectric active part 320. In this embodiment, the lower electrode film 60 functions as a common electrode of the piezoelectric element 300 and the upper electrode film 80 functions as an individual electrode of the piezoelectric element 300, however, even if these are reversed for the convenience of a driving circuit and wiring, no problem occurs. In any case, the piezoelectric active part is formed every pressure generating chamber. Here, the piezoelectric element 300 and a diaphragm displaced by driving the piezoelectric element 300 are called a piezoelectric actuator as a whole. In the above example, the elastic film 50 and the lower electrode film 60 act as a diaphragm, however, the lower electrode film may also function as the elastic film.

Figure 4:
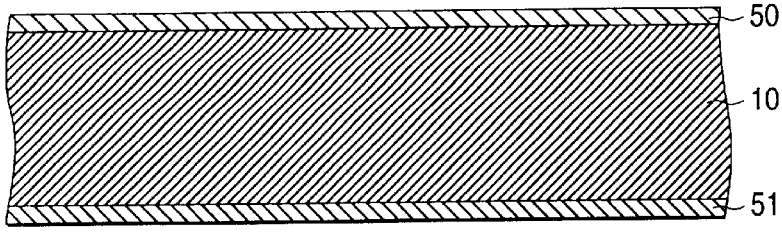
FIGS. 4(*a*)–(*b*) show a thin film manufacturing process in the first embodiment of the present invention.
Figure 4:
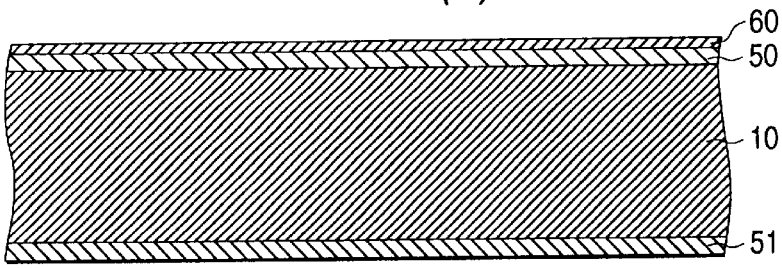
Figure 4:
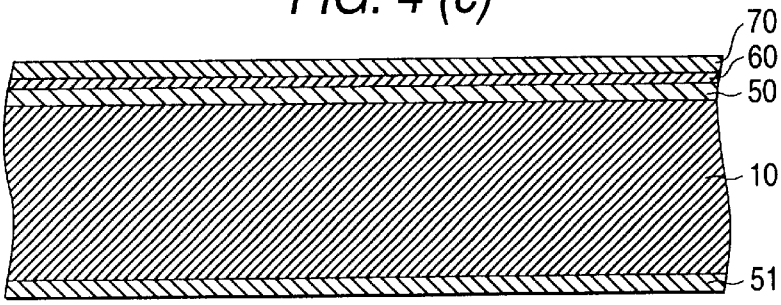
Figure 4:
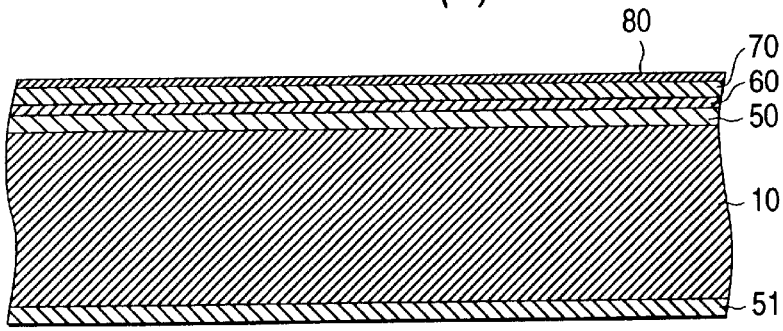

Referring to FIGS. 4, a process for forming the piezoelectric film 70 and others over the passage forming substrate 10 composed of a silicon monocrystalline substrate will be described below.

As shown in FIG. 4(*a*), first, a wafer of a silicon monocrystalline substrate to be the passage forming substrate 10 is thermally oxidized in a diffusion furnace heated approximately at 1100° C. and the elastic films 50 and 51 composed of silicon dioxide are once formed on both surfaces of the passage forming substrate 10.

Next, as shown in FIG. 4(*b*), the lower electrode film 60 is formed by sputtering. For the material of the lower electrode film 60, platinum (Pt) is suitable. This is because the piezoelectric film 70 formed by sputtering and so-gel transformation and described later is required to be crystallized by burning the formed piezoelectric film at the temperature of approximately 600 to 1000° C. under the atmosphere of the air or oxygen. That is, the material of the lower electrode film 60 is required to keep conductivity under such high-temperature and oxidizing atmosphere, it is desirable that particularly, if lead zirconate titanate (PZT) is used for the piezoelectric film 70, conductivity is hardly varied by the diffusion of PbO and Pt is suitable for these reasons.

Next, as shown in FIG. 4(*c*), the piezoelectric film 70 is formed. Sputtering may be also used for forming the piezoelectric film 70, however, in this embodiment, so-called sol-gel transformation wherein so-called sol in which a metallic organic substance is dissolved and dispersed in a solvent is applied, dried and gels and further, the piezoelectric film 70 composed of metallic oxide is obtained by burning it at high temperature is used. For the material of the piezoelectric film 70, PZT is desirable if it is used for an ink-jet recording head.

Next, as shown in FIG. 4(*d*), the upper electrode film 80 is formed. The material of the upper electrode film 80 has only to be very conductive material and many metals such as Al, Au, Ni and Pt, conductive oxide and others can be used. In this embodiment, the upper electrode film is formed using Pt by sputtering.

Figure 5:
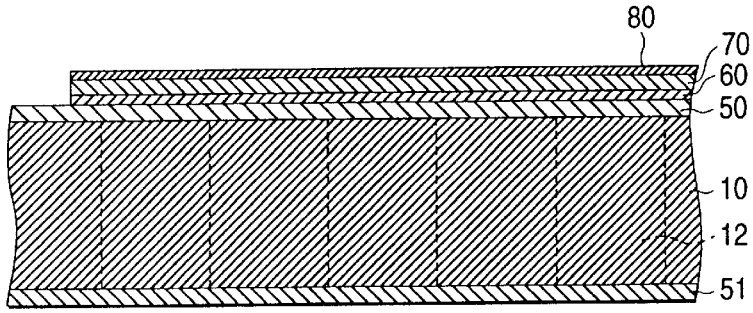
FIGS. 5(*a*)–(*b*) show the thin film manufacturing process in the first embodiment of the present invention.
Figure 5:
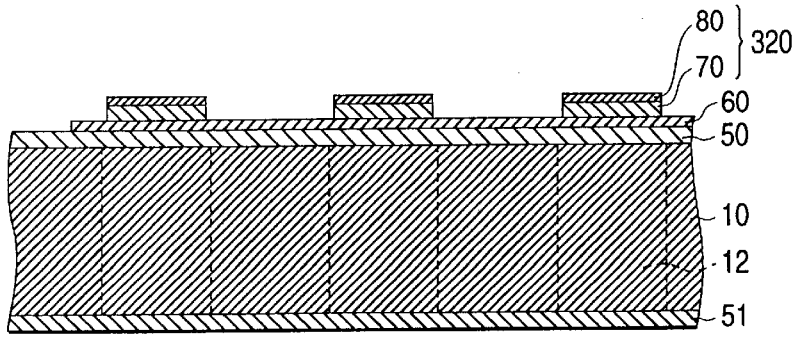

Next, as shown in FIGS. 5, the lower electrode film 60, the piezoelectric film 70 and the upper electrode film 80 are patterned.

First, as shown in FIG. 5(*a*), the lower electrode film 60, the piezoelectric film 70 and the upper electrode film 80 are etched together and patterned in accordance with the whole pattern of the lower electrode film 60. Next, as shown in FIG. 5(*b*), only the piezoelectric film 70 and the upper electrode film 80 are etched and the piezoelectric active part 320 is patterned.

As described above, patterning is completed by patterning the piezoelectric active part 320 after the whole pattern of the lower electrode film 60 is formed.

As described above, after the lower electrode film 60 and others are patterned, desirably, an insulating layer 90 provided with insulation performance from electricity is formed so that at least the edge of the upper surface of each upper electrode film 80 and the respective sides of the piezoelectric film 70 and the lower electrode film 60 are covered (refer to FIG. 1).

A contact hole 90*a* for exposing a part of the upper electrode film 80 to connect to a lead electrode 100 described later is formed in a part of a part covering the upper surface of a part corresponding to each communicating part 14 of the insulating layer 90. The lead electrode 100 one end of which is connected to each upper electrode film 80 via the contact hole 90*a* and the other end of which is extended to a connection terminal is formed. The lead electrode 100 is formed so that it is as narrow as possible to the extent that a driving signal can be securely supplied to the upper electrode film 80.

Figure 6:
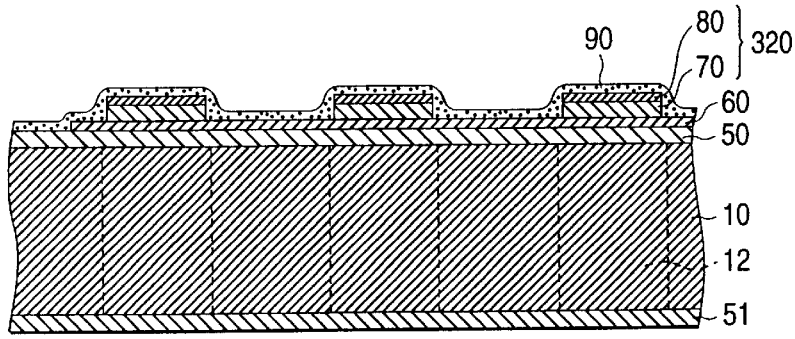
FIGS. 6(*a*)–(*b*) show the thin film manufacturing process in the first embodiment of the present invention.
Figure 6:
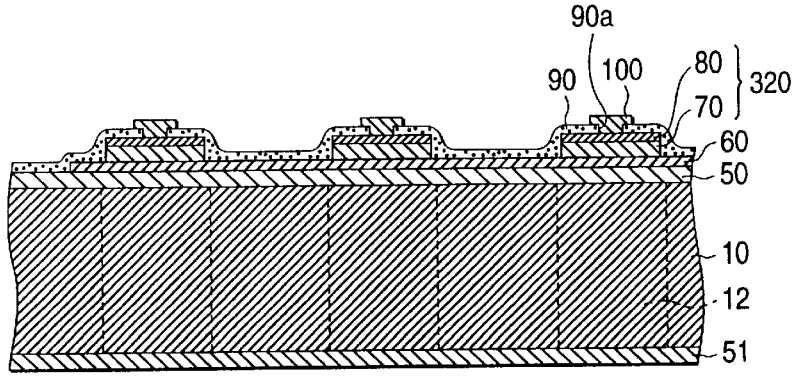

FIGS. 6 show a process in which such an insulating layer is formed.

First, as shown in FIG. 6(*a*), the insulating layer 90 is formed so that the edge of the upper electrode film 80 and the respective sides of the piezoelectric film 70 and the lower electrode film 60 are covered. The suitable material of the insulating layer 90 is described above, however, in this embodiment, negative photosensitive polyimide is used.

Next, as shown in FIG. 6(*b*), the contact hole 90*a* is formed in a part corresponding to each communicating part 14 by patterning the insulating layer 90. The contact hole 90*a* is provided to connect the lead electrode 100 and the upper electrode film 80.

The above is the film forming process. After the film is formed as described above, the anisotropic etching of the silicon monocrystalline substrate is executed using the above alkaline solution as shown in FIG. 7 in this embodiment, and the pressure generating chamber 12, the narrow part 13 and the communicating part 14 are simultaneously formed.

Figure 7:
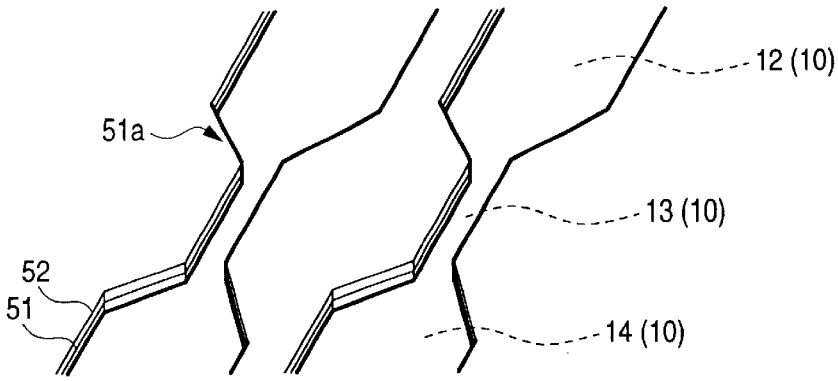
FIGS. 7(*a*)–(*b*) show an etching process in the first embodiment of the present invention.
Figure 7:
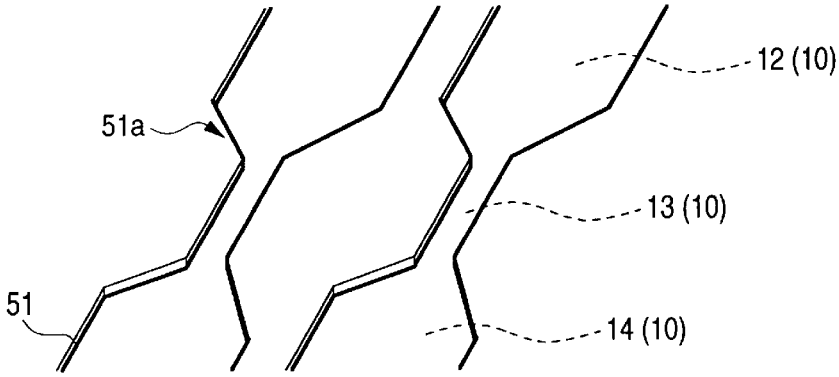
Figure 7:
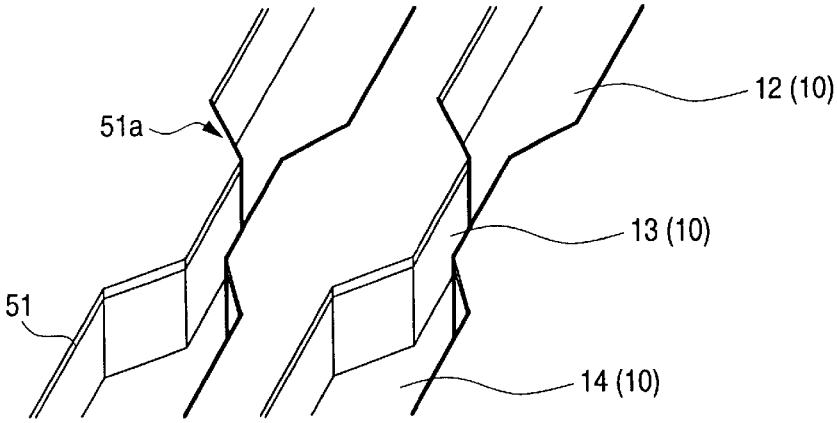

First, as shown in FIG. 7(*a*), a resist film 52 is formed on the elastic film 51 and patterned in accordance with the respective forms of the pressure generating chamber 12, the narrow part 13 and the communicating part 14. Next, the elastic film 51 in a part corresponding to the pattern of the resist film 52 is removed by etching and others. As described later, in this embodiment, a narrow part gradually narrowed is provided in the vicinity of the end on the side of the narrow part 13 of the pressure generating chamber 12. Therefore, the resist film 52 in a part corresponding to the narrow part is also patterned so that the resist film is gradually narrowed according to the form and a narrow part 51*a* gradually narrow is formed in a position corresponding to the vicinity of the end on the side of the narrow part 13 of the pressure generating chamber 12 of the elastic film 51.

Next, after the resist film 52 is removed as shown in FIG. 7(*b*), the silicon monocrystalline substrate, that is, the passage forming substrate 10 is removed up to the elastic film 50 by anisotropic etching by the above alkaline solution as shown in FIG. 7(*c*). Hereby, the pressure generating chamber 12, the narrow part 13 and the communicating part 14 are formed.

Heretofore, the above narrow part is formed by etching the silicon monocrystalline substrate by a half when the pressure generating chamber is formed and the inflow of ink into the pressure generating chamber is adjusted depending upon the height. However, as the etching rate of the silicon monocrystalline substrate is large in dispersion, it is difficult to adjust a set value and the surface of the bottom of the narrow part is rough by half-etching, there is a problem that many bubbles are included in ink.

However, as described above, in this embodiment, the inflow of ink into the pressure generating chamber is adjusted by always etching the silicon monocrystalline substrate up to the elastic film and varying the width of the narrow part. Therefore, the recording head can be readily manufactured and the inflow of ink can be adjusted. Further, as the bottom of the narrow part is constituted by the elastic film, the roughness of the surface is small and bubbles can be prevented from invading in ink.

Figure 8:
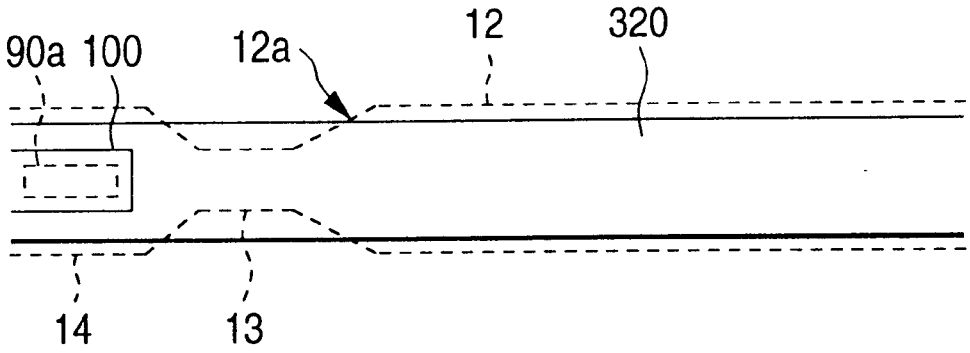
FIG. 8 is a plan showing the main part of the ink-jet recording head equivalent to the first embodiment of the present invention.

FIG. 8 is a plan showing the main part of the ink-jet recording head formed as described above.

In this embodiment, as shown in FIG. 8, the pressure generating chamber 12 communicates with the communicating part 14 via the narrow part 13 narrower than the width of the pressure generating chamber 12 at one end in its longitudinal direction. In this embodiment, a narrow part 12*a* in which the width of the pressure generating chamber 12 is gradually narrowed up to the width of the narrow part 13 is provided in the vicinity of the end on the side of the narrow part 13 of the pressure generating chamber 12. In such an area opposite to the pressure generating chamber 12, the piezoelectric active part 320 is provided, and the piezoelectric film 70 and the upper electrode film 80 are extended in the same width from one end in the longitudinal direction of the piezoelectric active part 320 to an area opposite to the narrow part 13 and the communicating part 14. The contact hole 90*a* for connecting the upper electrode film 80 and the lead electrode 100 is formed in the insulating layer 90 on the upper electrode film 80 provided in an area opposite to the communicating part 14.

The displacement of the piezoelectric active part 320 in a part corresponding to the narrow part 12*a* is inhibited by providing the narrow part 12*a* in the vicinity of the end in the longitudinal direction of the pressure generating chamber 12 as described above, and a crack, the breaking and others of the piezoelectric film due to the driving of the piezoelectric active part 320 can be prevented from being caused. As a connection between the upper electrode film 80 and the lead electrode 100 is formed in an area opposite to a passage communicating with the pressure generating chamber 12, the displacement of the piezoelectric active part 320 in an area corresponding to the pressure generating chamber 12 as a result is increased, that is, excluded volume in the pressure generating chamber 12 is increased.

As the upper electrode film 80 and the lead electrode 100 are connected in the contact hole 90*a* formed in a position opposite to the communicating part 14 relatively small in area, the displacement of the piezoelectric film in the vicinity of the contact hole 90*a* is hardly caused, and no crack and no breaking are caused.

Further, compliance can be mostly reduced by providing the contact hole 90*a* in a position opposite to the communicating part 14 and pressure by the driving of the piezoelectric active part 320 can be effectively utilized for jetting ink.

In such an ink-jet recording head, multiple chips are simultaneously formed on one wafer by the above series of the formation of films and anisotropic etching and after the process is finished, the wafer is divided into each passage forming substrate 10 in one chip size shown in FIG. 1. The divided passage forming substrate 10 is integrated by sequentially sticking the sealing plate 20, the common ink chamber forming substrate 30 and the ink chamber side plate 40 on it to be the ink-jet recording head.

In the ink-jet recording head constituted as described above, after ink is taken in from the ink inlet 42 connected to external ink supply means not shown and the inside from the common ink chamber 31 and the nozzle aperture 11 is filled with ink, pressure in the pressure generating chamber 12 is increased and an ink droplet is jetted from the nozzle aperture 11 by applying voltage between the lower electrode film 60 and the upper electrode film 80 via the lead electrode 100 according to a recording signal from an external driving circuit not shown and flexuously deforming the elastic film 50, the lower electrode film 60 and the piezoelectric film 70.

Figure 9:
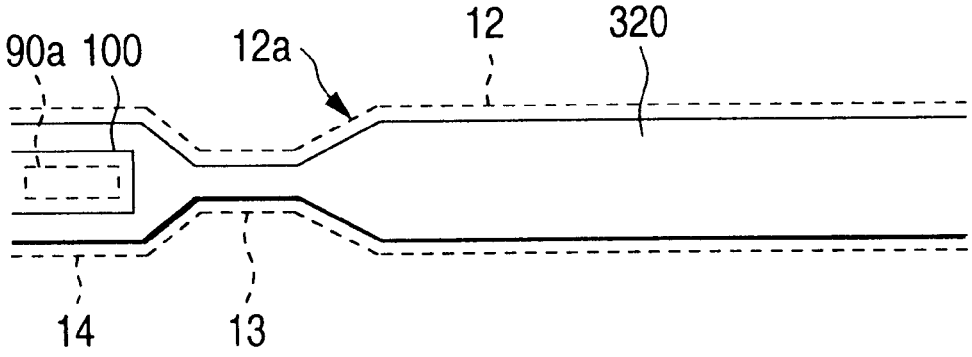
FIG. 9 is a plan of the main part showing a transformed example in the first embodiment of the present invention.

In this embodiment, the piezoelectric film 70 and the upper electrode film 80 are extended up to an area opposite to the communicating part 14 in the same width, however, the present invention is not limited to this and for example, as shown in FIG. 9, the piezoelectric film and the upper electrode film may be also formed only in an area corresponding to the pressure generating chamber 12, the narrow part 13 and the communicating part 14. Hereby, the breaking of the piezoelectric film in an area opposite to a boundary between the pressure generating chamber and the periphery is prevented.

Further, in the above embodiment, a contact between the lead electrode 100 and the upper electrode film 80 is provided in an area opposite to the communicating part 14, however, the present invention is not limited to this and the upper electrode film 80 may be also extended up to the end of the substrate and connected to an external electrode via an anisotropic conductive film and others.

Second Embodiment

Figure 10:
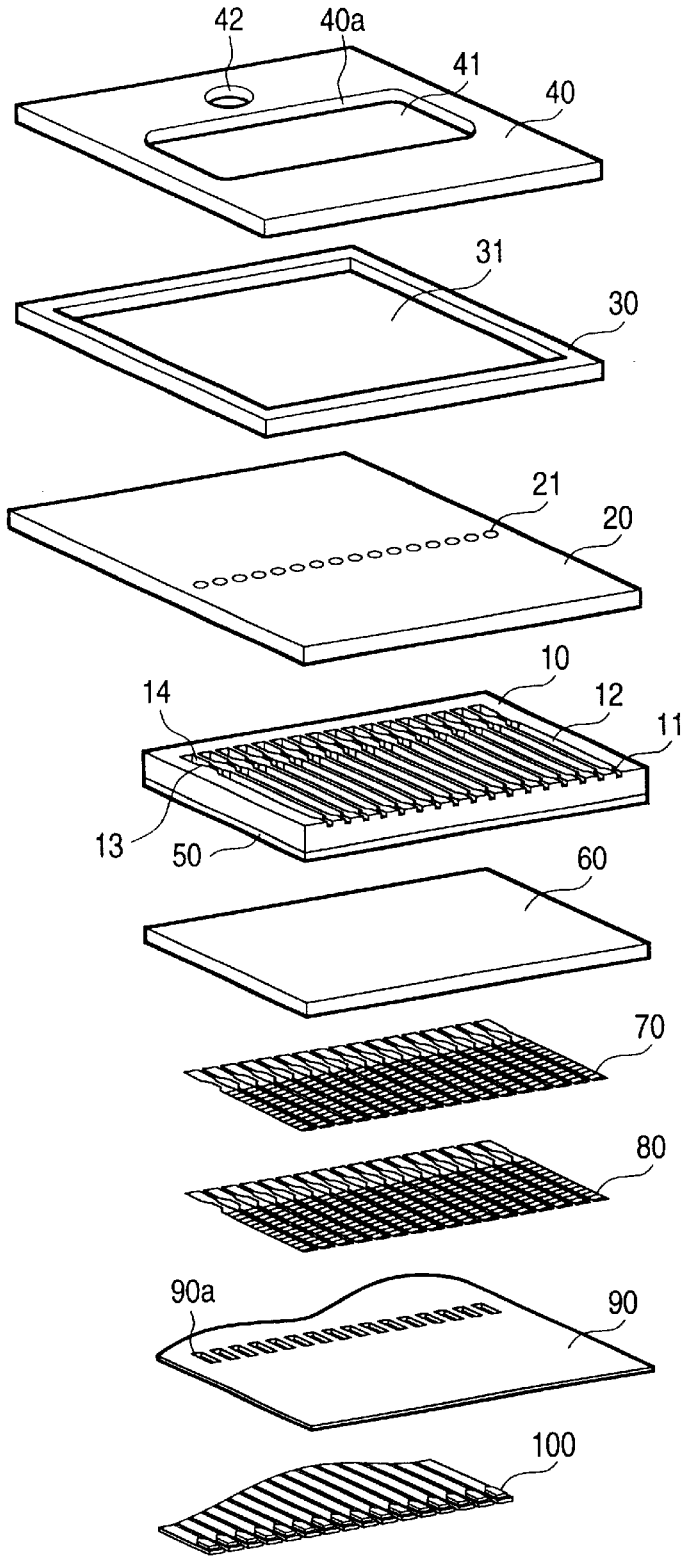
FIG. 10 is an exploded perspective view showing an ink-jet recording head equivalent to a second embodiment of the present invention.
Figure 11:
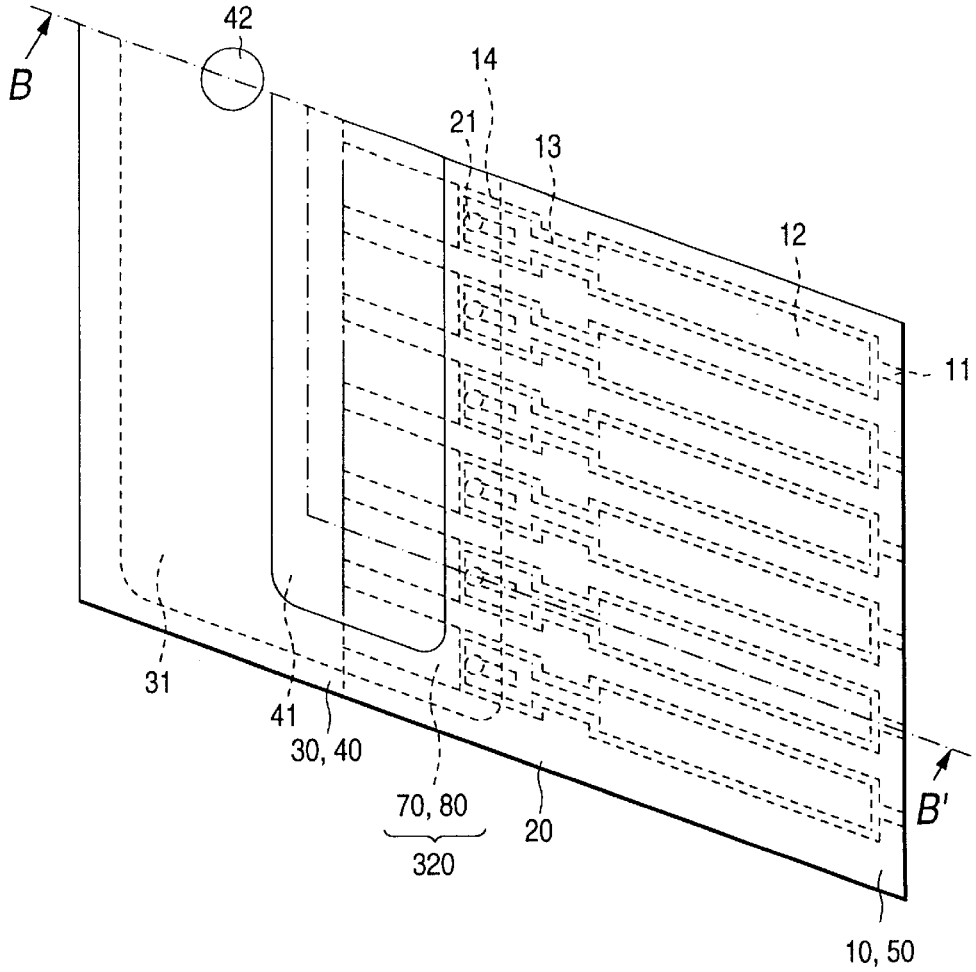
FIGS. 11(*a*)–(*b*) show the ink-jet recording head equivalent to the second embodiment of the present invention and are a plan of FIG. 10 and a sectional view.
Figure 11:
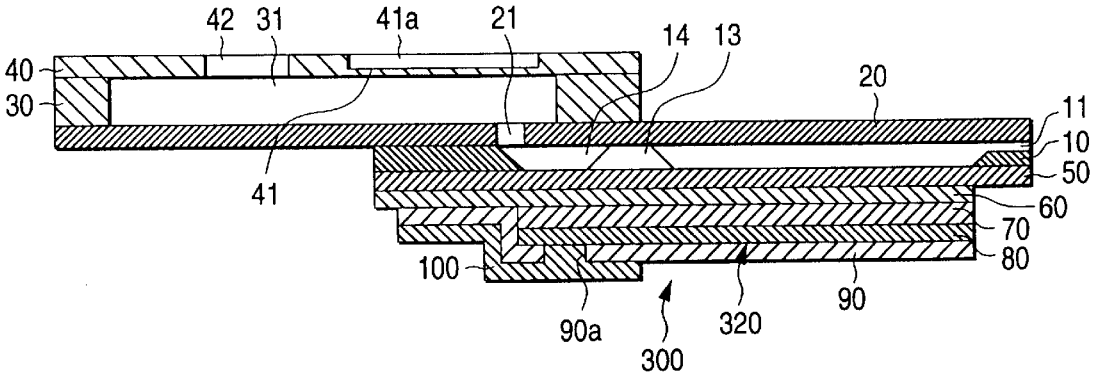

FIG. 10 is an exploded perspective view showing an ink-jet recording head equivalent to a second embodiment of the present invention and FIGS. 11 show a plan of FIG. 10 and sectional structure in the longitudinal direction of one pressure generating chamber. The basic structure in this embodiment shown in these drawings is the same as that in the above embodiment except that a narrow part gradually narrowed is not provided at the end on the side of a narrow part 13 of a pressure generating chamber 12, the same reference number is allocated to the same member and the description is omitted. For simplification, an elastic film 51 is not shown.

Figure 12:
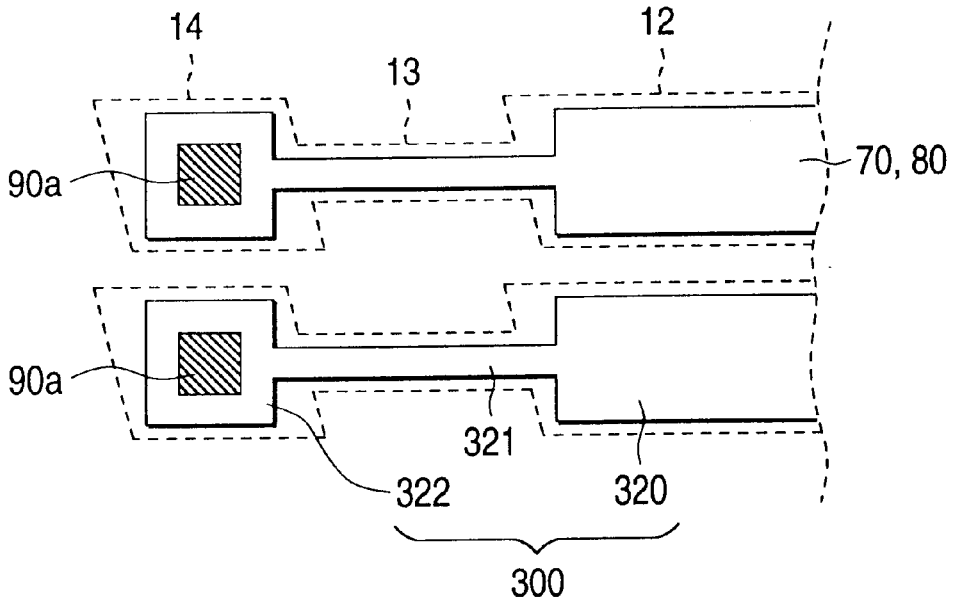
FIG. 12 is a plan showing the main part in the second embodiment of the present invention.

FIG. 12 shows positional relationship between a contact which is a connection between a lead electrode 100 and an upper electrode film 80 in this embodiment and the pressure generating chamber 12.

As shown in FIG. 12, in this embodiment, a piezoelectric film 70 and the upper electrode film 80 are patterned approximately in accordance with the form of the pressure generating chamber 12, the narrow part 13 and the communicating part 14, each piezoelectric element 300 includes a driving part 320 located over the pressure generating chamber 12, a lead 321 located over the narrow part 13 and a contact forming part 322 located over the communicating part 14, a window 90*a* of an insulating layer 90 is formed on the contact forming part 322 and the piezoelectric element is connected to the lead electrode 100 in the window 90*a*. That is, the contact forming part 322 for forming a connection to the lead electrode 100 is formed in a position opposite to the communicating part 14 not opposite to the pressure generating chamber 12.

Therefore, as the connection to the lead electrode 100 is not formed in a position opposite to the pressure generating chamber 12 but is formed in an area opposite to a passage communicating with the pressure generating chamber 12, the displacement of the driving part 320 corresponding to the pressure generating chamber 12 is increased as a result, exclude volume in the pressure generating chamber 12 is increased, and no crack and no breaking are caused by driving. As the contact forming part 322 forming the connection to the lead electrode 100 is formed in a position opposite to the communicating part 14 the area of which is relatively small, the displacement of the contact forming part 322 itself is hardly caused, and no crack and no breaking are caused in the contact forming part 322.

Further, most of compliance can be reduced by providing the contact forming part 322 in a position opposite to the communicating part 14 and pressure by the piezoelectric element 300 can be effectively utilized for jetting ink.

Figure 13:
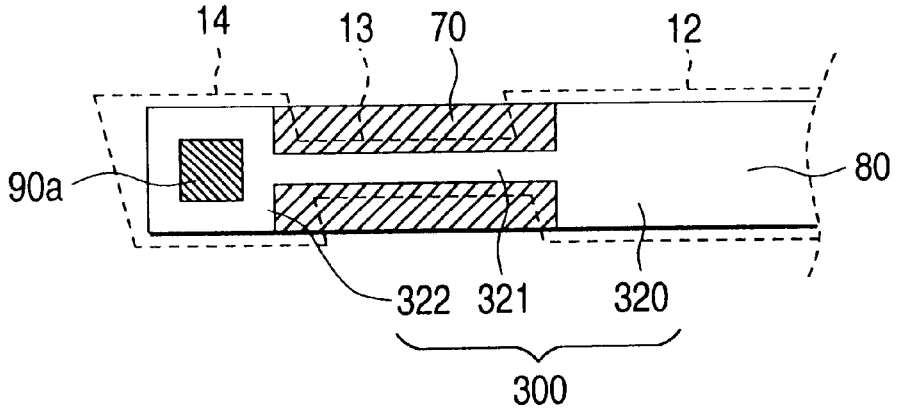
FIG. 13 is a plan of the main part showing a transformed example in the second embodiment of the present invention.
Figure 14:
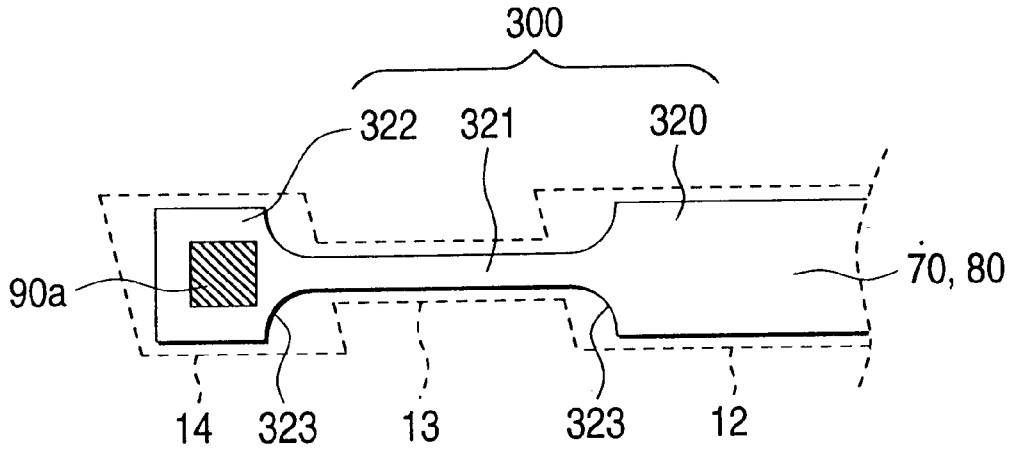
FIG. 14 is a plan of the main part showing a transformed example in the second embodiment of the present invention.
Figure 15:
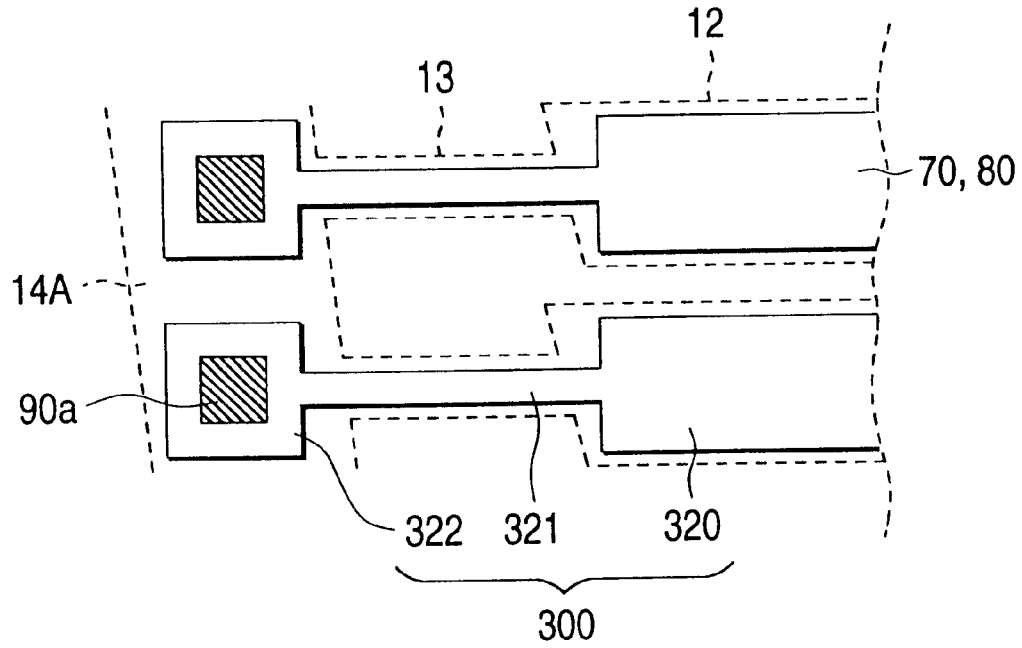
FIG. 15 is a plan of the main part showing a transformed example in the second embodiment of the present invention.

However, stress is readily concentrated particularly at both ends of the lead 321 and in a boundary between the driving part 320 and the contact forming part 322, however, to further prevent a crack and others from being caused in this part, each configuration shown in FIGS. 13 to 15 may be adopted.

That is, as shown in FIG. 13, the upper electrode film 80 is patterned approximately corresponding to the form of the pressure generating chamber 12, the narrow part 13 and the communicating part 14 as described above, however, a part opposite to the narrow part 13 of the piezoelectric film 70 may be also patterned in the same width as parts respectively opposite to the pressure generating chamber 12 and the communicating part 14. Hereby, as the piezoelectric film 70 also covers the outside of an ink passage in the part opposite to the narrow part 13, a crack is further hardly caused in a boundary between the part opposite to the pressure generating chamber 12 and the part opposite to the communicating part 14.

As shown in FIG. 14, an outside edge 323 which is each boundary between the lead 321 of the piezoelectric film 70 and the upper electrode film 80 and the driving part 320 and between the above lead 321 and the contact forming part 322 may be also formed in a radial form. Hereby, a crack in the boundary is further difficult to cause.

Further, the communicating part 14 separately formed corresponding to each pressure generating chamber 12 in the above embodiments may be also a common communicating part 14A as shown in FIG. 15. In this case, as the force of constraint of the contact forming part 322 is reduced, vibration can be further inhibited, and a crack and others are further difficult to cause in a boundary with the lead 321.

It need scarcely be said that each configuration shown in FIGS. 13 to 15 may be suitably combined.

Third Embodiment

Figure 16:
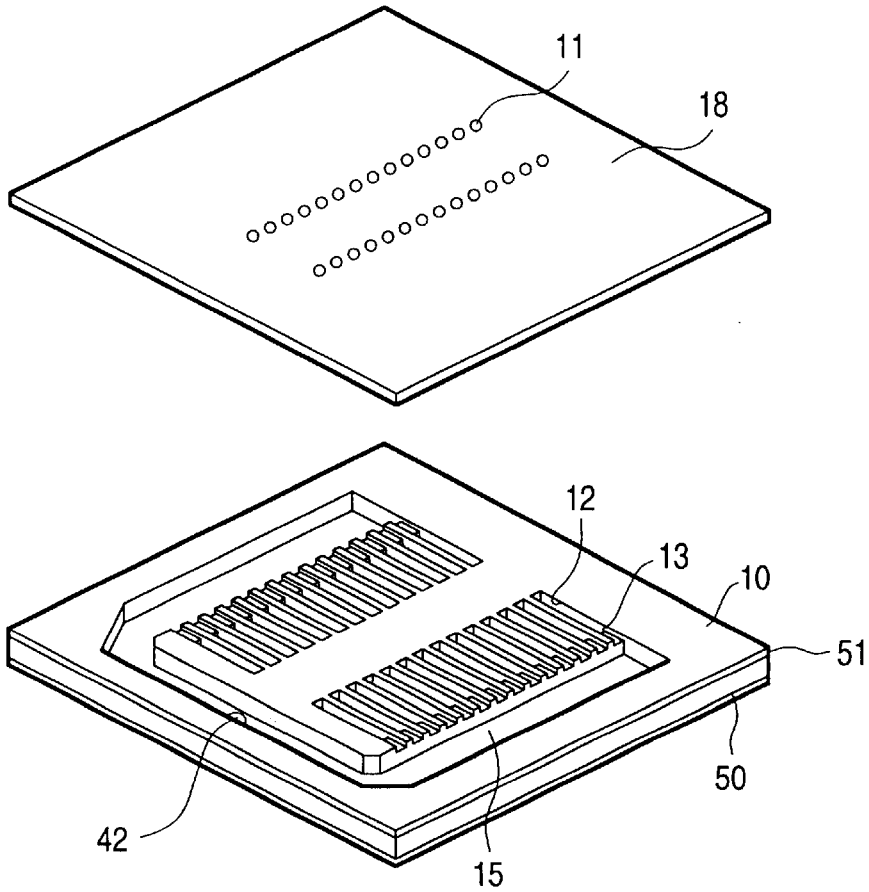
FIG. 16 is an exploded perspective view showing an ink-jet recording head equivalent to a third embodiment of the present invention.
Figure 17:
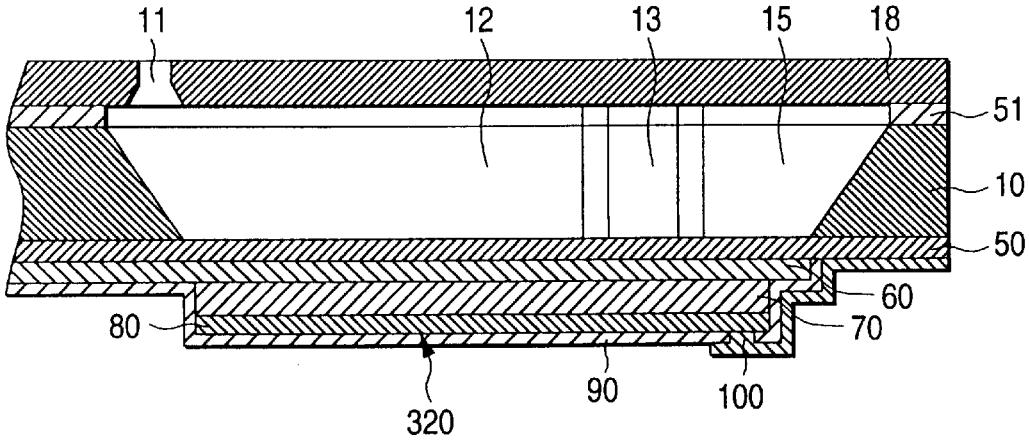
FIG. 17 is a sectional view showing the main part of the ink-jet recording head equivalent to the third embodiment of the present invention.

FIG. 16 is an exploded perspective view showing an ink-jet recording head equivalent to a third embodiment and FIG. 17 is a sectional view showing the main part.

In this embodiment, as shown in the drawings, communicating parts mutually communicate, a reservoir 15 to which ink is directly supplied from the outside is provided, and the reservoir 15 and a pressure generating chamber 12 communicate via a narrow part 13.

That is, the pressure generating chamber 12 and the reservoir 15 are formed on the side of the open face of a passage forming substrate 10 by etching and others and the reservoir 15 communicates with the end far from a nozzle aperture 11 of the pressure generating chamber 12 via the narrow part 13.

As the narrow part 13 is also formed by etching the passage forming substrate 10 up to an elastic film 50 in this embodiment, adjustment in the direction of the thickness of the narrow part 13 is not required and the narrow part can be readily formed. The inflow of ink from the reservoir 15 to the pressure generating chamber 12 can be readily adjusted by adjusting the width of the narrow part 13.

A nozzle plate 18 in which nozzle apertures 11 communicating with each pressure generating chamber 12 on the reverse side to the reservoir 15 are made is fixed on an elastic film 51 on the side of the open face of the passage forming substrate 10 via an adhesive, a thermally welding film and others.

An elastic film 50 is formed on the reverse side to the open face of the passage forming substrate 10 as in the first embodiment and a piezoelectric active part 320 composed of a lower electrode film 60, a piezoelectric film 70 and an upper electrode film 80 is formed on the elastic film 50. Further, a contact between the upper electrode film 80 of each piezoelectric active part 320 and a lead electrode 100 is provided in an area opposite to the reservoir 15.

According to such configuration, the similar effect to the effect in the first embodiment can be produced.

Other Embodiments

Some embodiments of the present invention are described above, however, the basic configuration of the ink-jet recording head is not limited to the above.

For example, the common ink chamber forming plate 30 may be also composed of glass ceramics in addition to the above sealing plate 20, further, the thin wall 41 may be also composed of glass ceramics as another member and change in material, structure and others is free.

Figure 18:
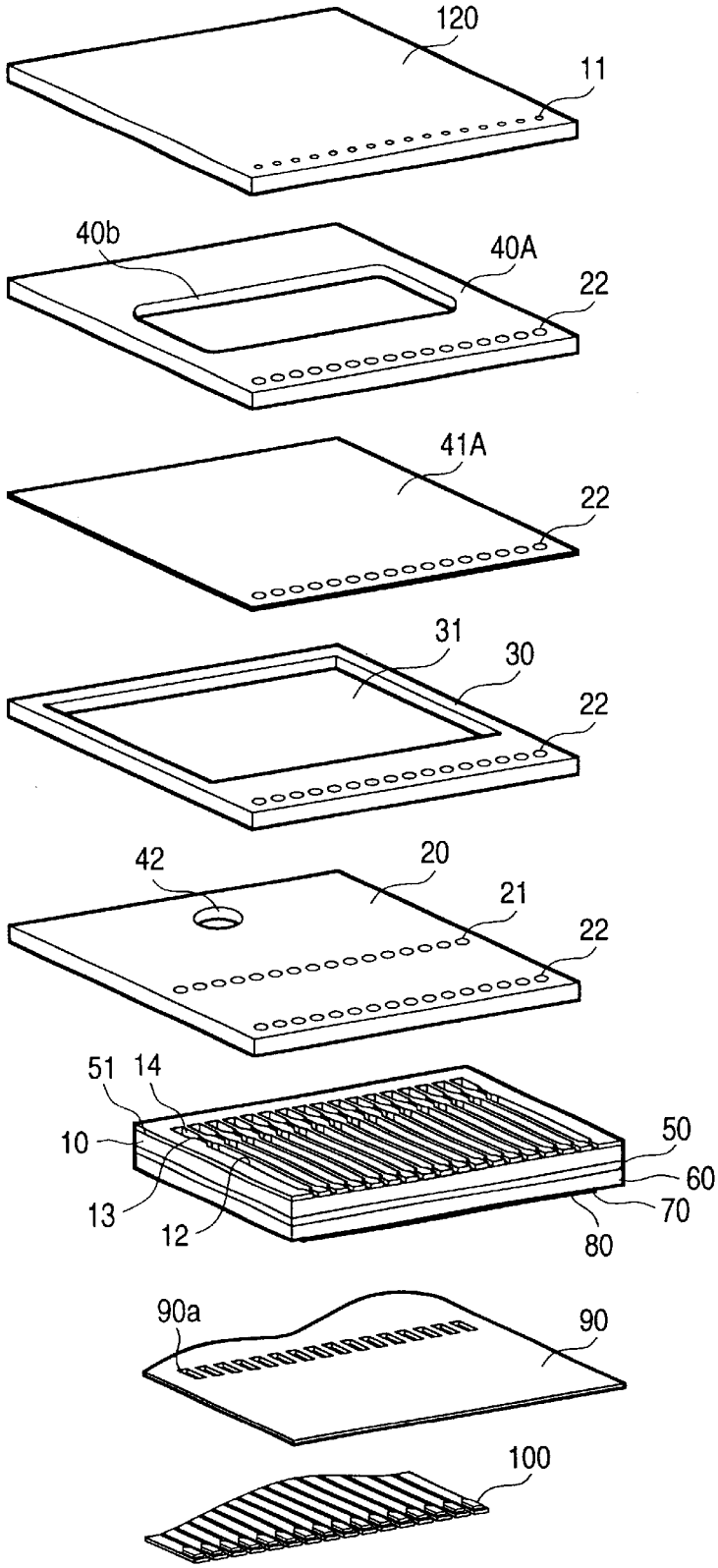
FIG. 18 is an exploded perspective view showing an ink-jet recording head equivalent to another embodiment of the present invention.
Figure 19:
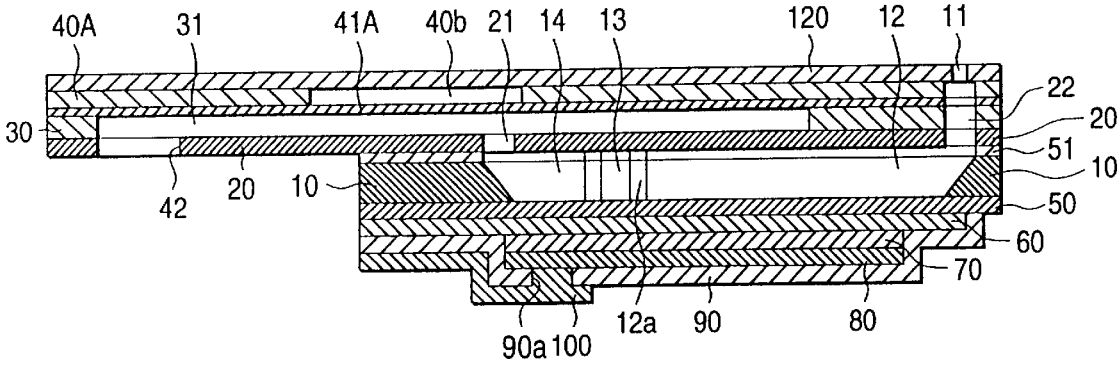
FIG. 19 is a sectional view showing an ink-jet recording head equivalent to the other embodiment of the present invention.

FIG. 18 is an exploded perspective view showing an embodiment constituted as described above and FIG. 19 shows the section of a passage. In this embodiment, a nozzle aperture 11 is made in a nozzle substrate 120 on the reverse side to a piezoelectric element and a nozzle communicating port 22 for connecting the nozzle aperture 11 and a pressure generating chamber 12 pierces a sealing plate 20, a common ink chamber forming plate 30, a thin plate 41A and an ink chamber side plate 40A.

This embodiment is basically the same as the above embodiments except that the thin plate 41A and the ink chamber side plate 40A are constituted by different members and an opening 40*b* is formed in the ink chamber side plate 40A, the same reference number is allocated to the same member and the description is omitted.

In this embodiment, a narrow part 12*a* is also provided in the vicinity of the end in the longitudinal direction of the pressure generating chamber 12 and a contact hole 90*a* is formed in a position opposite to a communicating part 14. Therefore, in this embodiment, the similar effect to the effect in the above embodiments is also produced.

In the above embodiments, the thin film type ink-jet recording head which can be manufactured by applying a film forming process and a lithographic process is given as the examples, however, naturally, the present invention is not limited to these and the present invention can be applied to an ink-jet recording head with various structure such as a pressure generating chamber is formed by laminating substrates, a piezoelectric film is formed by sticking a green sheet or screen printing and others and a piezoelectric film is formed by crystal growth.

As described above, the effect of the present invention can be produced by providing the connection between the piezoelectric element and the lead electrode in an area opposite to the passage communicating with the pressure generating chamber outside an area opposite to the pressure generating chamber and as long as the purpose is not infringed, the present invention can be applied to an ink-jet recording head with various structure.

Figure 20:
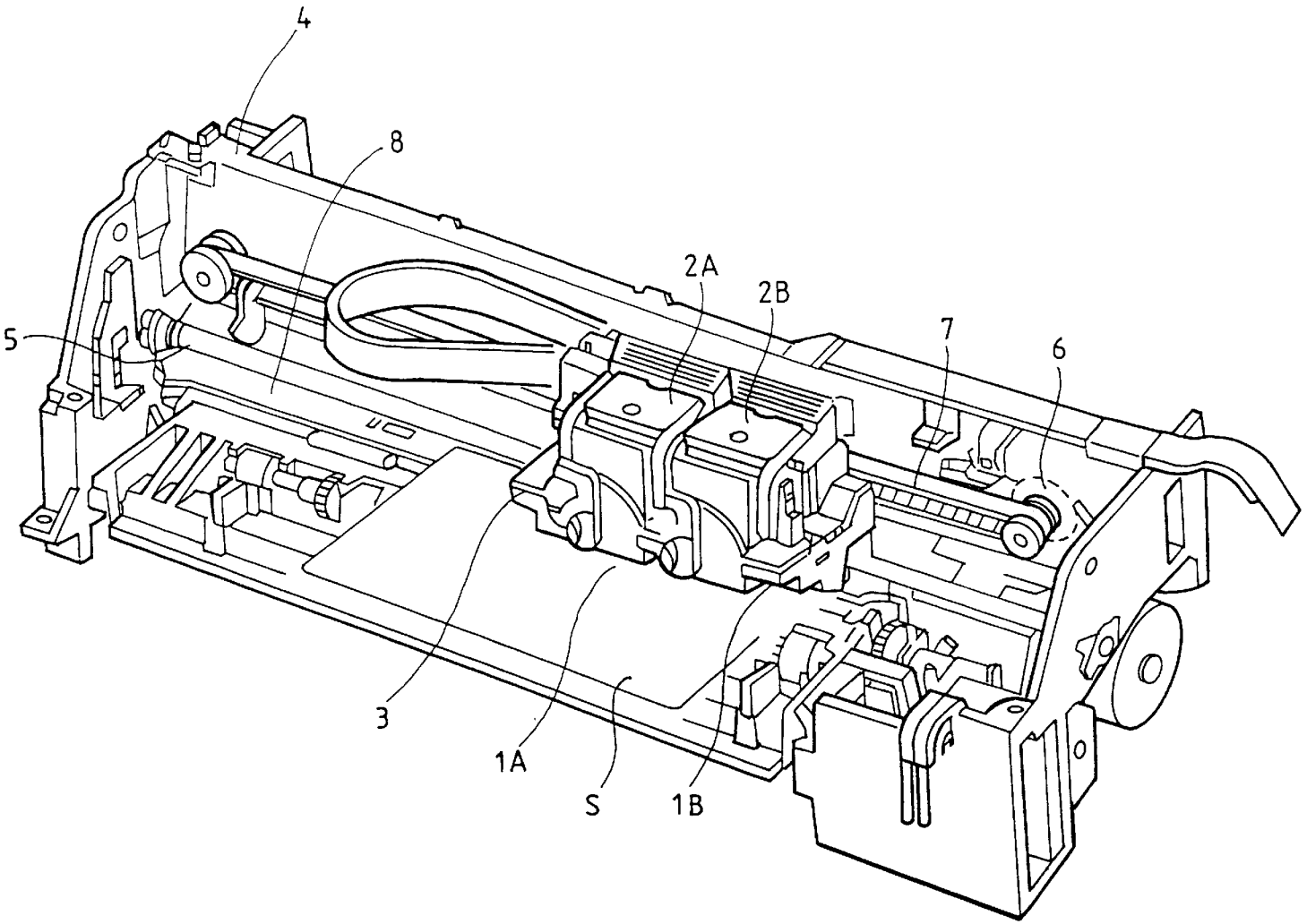
FIG. 20 is a schematic drawing showing an ink-jet recording device equivalent to an embodiment of the present invention.

The ink-jet recording head in the above each embodiment constitutes a part of a recording head unit provided with an ink passage communicating with an ink cartridge and others and is mounted in an ink-jet recording device. FIG. 20 is a schematic drawing showing an example of the ink-jet recording device.

As shown in FIG. 20, recording head units 1A and 1B respectively provided with an ink-jet recording head are provided so that cartridges 2A and 2B constituting ink supply means can be detached and a carriage 3 mounting the recording head units 1A and 1B is provided to a carriage shaft 5 attached to the body 4 of the recording device so that the carriage can be moved axially. The recording head units 1A and 1B respectively jet black ink composition and color ink composition.

As the driving force of a driving motor 6 is transmitted to the carriage 3 via plural gears not shown and a timing belt 7, the carriage 3 mounting the recording head units 1A and 1B is moved along the carriage shaft 5. In the meantime, a platen 8 is provided to the body 4 of the recording device along the carriage shaft 5 so that a recording sheet S which is a recording medium such as paper fed by a paper feed roller not shown and others is wound on the platen 8 and carried.

As described above, according to the present invention, as the narrow part gradually narrowed is provided in the vicinity of the end in the longitudinal direction of the pressure generating chamber, the deformation of the diaphragm by the driving of the piezoelectric active part is inhibited and the generation of a crack, breaking and others can be inhibited.

The quantity of displacement of the pressure generating chamber by the piezoelectric element can be increased by providing the connection between the lead electrode for applying voltage to the piezoelectric element and the corresponding piezoelectric element in an area other than an area opposite to the pressure generating chamber. As a result, as excluded volume in the pressure generating chamber is increased and no connection exists in the area opposite to the pressure generating chamber, effect that no crack and no breaking are caused by driving is produced.

What is claimed is:

1. A method of manufacturing an ink-jet recording head in which a piezoelectric element is formed in an area corresponding to a pressure generating chamber by sequentially laminating a lower electrode layer, a piezoelectric layer and an upper electrode layer on an elastic film provided on one side of a passage forming substrate and patterning each layer and said pressure generating chamber communicating with a nozzle aperture is formed by etching said passage forming substrate from the other side, wherein:

a step for forming a narrow part which communicates with one end of said pressure generating chamber and is narrower than the width of the corresponding pressure generating chamber is provided by etching said passage forming substrate.

2. A method of manufacturing an ink-jet recording head according to claim 1, wherein:

said step for forming said narrow part is simultaneously executed with a step for forming said pressure generating chamber by etching.

3. A method of manufacturing an ink-jet recording head according to claim 1, wherein;

said pressure generating chamber is formed on a silicon monocrystalline substrate by anisotropic etching; and each layer of said piezoelectric element is formed by a thin film forming method and a lithographic method.

4. A method of manufacturing an ink-jet recording head according to claim 2, wherein:

said pressure generating chamber is formed by a silicon monocrystalline substrate by anisotropic etching; and each layer of said piezoelectric element is formed by a thin film forming method and a lithographic method.

* * * * *